US008267700B2

(12) United States Patent
Mizoguchi

(10) Patent No.: US 8,267,700 B2
(45) Date of Patent: Sep. 18, 2012

(54) CONNECTOR STRUCTURE

(75) Inventor: Masanori Mizoguchi, Nerima-ku (JP)

(73) Assignee: Asahi Denka Kenkyusho Co., Ltd., Tokyo (JP)

( * ) Notice: Subject to any disclaimer, the term of this patent is extended or adjusted under 35 U.S.C. 154(b) by 0 days.

(21) Appl. No.: 12/992,479

(22) PCT Filed: May 7, 2009

(86) PCT No.: PCT/JP2009/058642

§ 371 (c)(1),
(2), (4) Date: Jun. 6, 2011

(87) PCT Pub. No.: WO2009/139323

PCT Pub. Date: Nov. 19, 2009

(65) Prior Publication Data

US 2011/0269321 A1 Nov. 3, 2011

(30) Foreign Application Priority Data

May 15, 2008 (JP) ..... 2008-128331

(51) Int. Cl.
*H01R 12/00* (2006.01)

(52) U.S. Cl. ..... 439/67

(58) Field of Classification Search ..... 439/67, 439/82, 65

See application file for complete search history.

(56) References Cited

U.S. PATENT DOCUMENTS 3,077,211 A * 2/1963 Brooks ..... 242/439.1
3,214,827 A * 11/1965 Prohofsky ..... 29/830
3,541,223 A * 11/1970 Helms ..... 174/262
3,541,225 A * 11/1970 Raciti ..... 174/74 R
3,795,047 A * 3/1974 Abolafia et al. ..... 29/843
3,859,711 A * 1/1975 McKiddy ..... 29/593
4,720,470 A * 1/1988 Johnson ..... 438/598
4,929,185 A * 5/1990 Wong et al. ..... 439/74
4,934,712 A * 6/1990 Byrd ..... 273/333
5,030,110 A * 7/1991 Groves et al. ..... 439/69
2009/0233465 A1 9/2009 Mizoguchi

FOREIGN PATENT DOCUMENTS

JP 11 329628 11/1999
JP 4 059 522 3/2008

OTHER PUBLICATIONS

International Search Report issued Jul. 7, 2009 in PCT/JP09/058642 filed May 7, 2009.
U.S. Appl. No. 12/741,108, filed Oct. 12, 2010, Mizoguchi.

* cited by examiner

*Primary Examiner* — Tulsidas C Patel
*Assistant Examiner* — Phuongchi Nguyen
(74) *Attorney, Agent, or Firm* — Oblon, Spivak, McClelland, Maier & Neustadt, L.L.P.

(57) ABSTRACT

A connector structure which can realize height reduction of connecting portions and space saving and which prevents separation of a female connector and a male connector from each other due to an impact or vibrations, wherein a conduction structure is formed by bringing connecting pins (9) of a male connector ($B_2$), which are inserted in female terminal portions installed in a flexible circuit board ($B_3$) of a female connector ($B_1$), into pressure contact with pad portions of the female terminal portions (3), and the female connector ($B_1$) and the male connector ($B_2$) are coupled with each other by inserting column-shaped projections (15) of the male connector ($B_2$) into notch ring bodies (14) fixed on the flexible circuit board ($B_3$) of the female connector ($B_1$) and holding the column-shaped projections (15) by restoring force based on elastic deformation of the notch ring bodies (14).

25 Claims, 11 Drawing Sheets

CONNECTOR STRUCTURE

TECHNICAL FIELD

The present invention relates to a connector structure and in particular to a connector structure in which a flexible circuit board is used and a female connector and a male connector manufactured by application of plating technique and photolithography technique are used.

BACKGROUND ART

In recent years, size-reducing, thinning, weight-reducing, and multi-functioning of various electric/electronic apparatuses have rapidly advanced, and, in particular, in the fields of mobile phones, flat panel displays, and various mobile apparatuses, the competition over thinning between companies is intense. Such a trend, of course, increases a demand for size-reducing/thinning of various electric/electronic parts mounted on circuit boards installed in these electric/electronic apparatuses.

Further, a connector that relays electrical connection between circuit parts is also required to be reduced in size and thinned, and, in terms of the connector, size-reducing thereof can be made by achieving a narrow pitch (space saving) between connector terminals, and thinning thereof can be achieved by reducing the height of a connecting portion.

A female connector and a male connector, particularly, the female connector is conventionally manufactured by performing punching work using a die to a metal plate material. However, in the case of a connector structure in which the female connector and the male connector manufactured by this method were connected to each other, it was very difficult to reduce the height of a connecting portion to 1.0 mm or less, and narrow a pitch between terminals to 0.5 mm or less.

Further, in such a conventional manufacturing method, with further size reduction and thinning of connectors to be manufactured, there is such a problem that product failures occur frequently, assembling workability is poor, mounting failure occurs when it is mounted on a circuit board by soldering, and therefore disconnection of the female connector and the male connector from each other occurs between connector connecting portions on impact at an assembling time of an apparatus.

In order to solve such a problem, a connector structure in which a flexible circuit board was used and in which a female connector and a male connector manufactured by using plating technique and photolithography technique were assembled to each other was developed (see Patent Literature 1).

In this connector structure, a female connector and a male connector can be repeatedly attached to and detached from each other, the height of a connecting portion between the female connector and the male connector can easily be reduced to 0.5 mm or less, and a pitch between terminals can be narrowed to 0.5 mm or less, so that the connector structure can be said to be excellent in height reduction and space saving.

Patent Literature 1: Japanese Patent No. 4059522

SUMMARY OF INVENTION

Technical Problem

The connector structure according to the Patent Literature 1 described above is excellent in height reduction and space saving. However, in the course of examination of improvement in actual use of the connector structure, it has been founded that there remains problems, such as further improvement in assembling workability of the female connector and the male connector to each other, and capability of maintaining firmer connection at the connecting portion between both the connectors even if, for example, an external impact or external vibrations are applied thereto after both the connectors are assembled to each other.

An object of the present invention is to provide a connector structure with a novel structure which solves the above problems while utilizing the excellent points which the above connector structure according to Patent Literature 1 has, which can achieve height reduction and space saving of a connecting portion between a female connector and a male connector that is formed by assembling both the connectors to each other, which makes it possible to attach/detach the female connector and the male connector to/from each other repeatedly, which makes it possible to perform assembling work of the female connector and the male connector smoothly, and which has large and stable retaining force between the connectors after assembled.

Solution to Problem

In order to solve the above problem, according to the present invention, there is provided a connector structure constructed by assembling a female connector provided with a flexible circuit board including female terminal portions comprising an insulating film having flexibility, a plurality of pad portions formed on one face of the insulating film, conductor circuit patterns drawn out of the pad portions, first through-holes formed in a thickness direction of the insulating film within faces of the pad portions, and small holes communicating coaxially with the first through-holes and formed within the faces of the pad portions; and a female-side engaging member which is a foil-like body fixedly arranged on the opposite face of the flexible circuit board from a formation face of the pad portions thereof and which has second through-holes with a size larger than those of the first through-holes communicating coaxially with the first through-holes in the female terminal portions and formed in a thickness direction of the foil-like body; and a male connector provided with a circuit board including male terminal portions comprising an insulating member, connecting pins formed in a projecting manner on one face of the insulating member at positions corresponding to the female terminal portions, and conductor circuit patterns drawn out of proximal portions of the connecting pins; and a male-side engaging member which is fixedly arranged on the same face as a formation face of the connecting pins of the circuit board and is engaged with the female-side engaging member of the female connector, wherein the female-side engaging member is fixedly arranged on the flexible circuit board in the state where the respective female terminal portions and portions of the flexible circuit board positioned in the vicinities of the female terminal portions are positioned within the respective faces of the second through-holes and the other portion of the flexible circuit board and the female-side engaging member are integrated with each other.

In this case, the female-side engaging member has an elastically deformable portion formed as a portion of the foil-like body outside the second through-holes, and the circuit board of the male connector may be a flexible circuit board like the case of the female connector, or it may be a rigid circuit board.

Further, the female-side engaging member and the male-side engaging member are fixedly arranged on the flexible circuit board and the circuit board, respectively, so as to maintain such a predetermined positional relationship that the female terminal portions and the male terminal portions can be connected to each other, and either one or both of the female-side engaging member and the male-side engaging member exert a positioning and guiding function to the other at an engaging time of the female-side engaging member and the male-side engaging member and a retaining function to the other after the female-side engaging member and the male-side engaging member are engaged with each other.

Specifically, there is provided the connector structure, wherein at an assembling time of the female connector in which the female-side engaging member has the aforementioned elastically deformable portion and the male connector to each other, the connecting pins of the male terminal portions are inserted through the small holes into the first through-holes of the female terminal portions from the formation face of the pad portions, the pad portions and portions of the insulating film on which the pad portions are formed are flexed in an insertion direction of the connecting pins, and the pad portions are brought into pressure contact with the connecting pins by elasticity of the pad portions and the insulating film, and the female-side engaging member of the female connector is engaged with the male-side engaging member of the male connector, the elastically deformable portion of the female-side engaging member is brought into pressure contact with the male-side engaging member by elastic force based on elastic deformation of the elastically deformable portion, so that a retaining function between the female-side engaging member and the male-side engaging member is exerted.

More specifically, there is provided the connector structure, wherein the elastically deformable portion of the female-side engaging member is a spring arm portion formed on each of both side portions of the foil-like body by providing a wedge-shaped slit whose width becomes narrower along a longitudinal direction of the foil-like body, the male-side engaging member is a frame-like body which partially surrounds the connecting pins and which has a receiving portion for receiving the female-side engaging member and a drawing notch portion for drawing the flexible circuit board, and at an engaging time of the female-side engaging member and the male-side engaging member with each other, an outer wall face of the spring arm portion is brought in pressure contact with an inner wall face on each of both side portions of the frame-like body (hereinafter, this connector structure is referred to as a connector structure A); and there is provided the connector structure, wherein the elastically deformable portion of the female-side engaging member is a notch ring body formed integrally with the female-side engaging member, the male-side engaging member is a column-shaped projection having a larger diameter than an inner diameter of the notch ring body, and at the engaging time of the female-side engaging member and the male-side engaging member with each other, the notch ring body is in pressure contact with the column-shaped projection by elastic force (restoring force) of the notch ring body diametrically expanded (hereinafter, this connector structure is referred to as a connector structure B).

Further, according to the present invention, there is provided the connector structure, wherein a layer of adhesive agent is formed partially or entirely on the face of the flexible circuit board except for the formation face of the pad portions, or partially or entirely on the face of the circuit board except for the formation face of the connecting pins, the connecting pins of the male terminal portions are inserted via the small holes into the first through-holes of the female terminal portions from the formation face of the pad portions, the pad portions and portions of the insulating film on which the pad portions are formed are flexed in an insertion direction of the connecting pins, the pad portions are brought into pressure contact with the connecting pins by elasticity of the pad portions and insulating film, and the female connector and the male connector are bonded to each other via the layer of adhesive agent (hereinafter, this connector structure is referred to as a connector structure C).

Further, according to the present invention, a female connector and a male connector that are used to assemble the connector structure described above are provided, and a flexible circuit board provided with the female connector described above and a flexible circuit board or a rigid circuit board provided with the male connector described above are provided.

Advantageous Effects of Invention

The connector structure according to the present invention is assembled by assembling the female connector and the male connector which have the above structures to each other, and, when both the connectors are assembled to each other, the connecting pins (the male terminal portions) formed on the circuit board itself which is a mating member to the flexible circuit board are inserted into the female terminal portions formed on the flexible circuit board itself through the small holes from the formation face of the pad portions to be inserted into the first through-holes, so that both the terminal portions are connected to each other and the female-side engaging member and the male-side engaging member are simultaneously engaged with each other.

Since the pad portions of the female terminal portions are formed from highly elastic material, the pad portions are flexed and elastically deformed at an insertion time of the connecting pins in an insertion direction thereof and brought into pressure contact with the connecting pins by restoring force of the pad portions, so that a conduction structure is formed, and simultaneously the connecting pins (the male terminal portions) are mechanically held by the female terminal portions.

Here, on one face of the flexible circuit board of the female connector, the female-side engaging member having the second through-holes that are larger in diameter than the first through-holes of the female terminal portions is fixedly arranged with the female terminal portions included within the faces of the second through-holes. In other words, portions of the flexible circuit board that are positioned in the vicinities of the first through-holes are integrated with the female-side engaging member so that they are fixed to the female-side engaging member.

That is, the portions of the flexible circuit board that are positioned in the vicinities of the first through-holes are prevented from flexing itself or bending itself backward, as long as the female-side engaging member is not flexed or bent backward.

Therefore, all the female terminal portions positioned within the faces of the second through-holes are present at predetermined designed positions, keeping flexibility, without causing generating two-dimensional or three-dimensional positional deviation. From this reason, when the female connector and the male connector are assembled to each other, the connecting pins projecting at predetermined designed positions and the female terminal portions are collectively connected to each other at once without causing positional deviation.

Further, since the female-side engaging member is integrally provided with the elastically deformable portions such as the spring arm portions (in the case of the connector structure A) or the notch ring bodies (in the case of the connector structure B) and the female-side engaging member is engaged with the male-side engaging member while the elastically deformable portions are being deformed, the elastically deformable portions are brought into pressure contact with the male-side engaging member by the restoring force of the elastically deformable portions, and thus the female-side engaging member is firmly held by the male-side engaging member.

Further, in the case of the connector structure C in which the elastically deformable portions are not formed in the female-side engaging member, at the same time as the terminal portions of both the connectors are connected to each other, the female connector and the male connector are bonded and fixed to each other by the layer of adhesive agent formed on faces of opposite faces of the female connector and the male connector except the formation faces of the female terminal portions and the male terminal portions, so that the connection between both the connectors is firmly held.

Therefore, in the cases of these connector structures according to the present invention, the retaining force between both the connectors is much larger and more stable, and the reliability of connection between both the connectors is higher, as compared with those in the case of the connector structure that is not provided with engaging members (the connector structure disclosed in Japanese Patent No. 4059522).

Since the female terminal portions of the female connector are formed in the flexible circuit board itself using the thin insulating film as a base member, and the male terminal portions of the male connector are bump-like connecting pins formed on a surface of the circuit board in a projecting manner, the connecting portions between both the connectors are reduced in height, and it is also possible to realize a space-saving multiple-pin structure in which the female terminal portions and the male terminal portions are two-dimensionally arranged in a matrix and a pitch between terminals is made narrow.

Accordingly, since the connector structure can sufficiently meet the requirements of downsizing and thinning and have large and stable retaining force between connectors, the connector structure can also be used as a highly-reliable connector structure in an electric/electronic apparatus to which an external impact or vibrations are applied.

DESCRIPTION OF EMBODIMENTS

Figure 1:
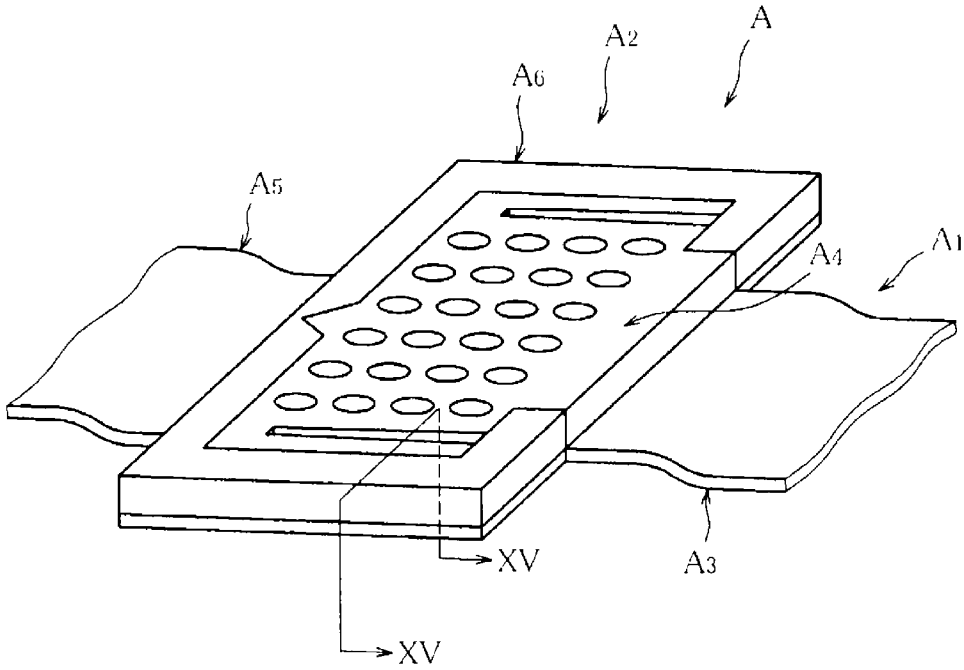
FIG. 1 is a perspective view showing a connector structure A of the present invention.

In a connector structure according to the present invention, as described later, female terminal portions formed on a flexible circuit board itself and male terminal portions formed on another circuit board itself are assembled to each other so that connecting portions of both the circuit boards are formed.

Further, engaging members are, as described later, fixedly arranged at predetermined portions on the respective circuit boards corresponding to the connecting portions thereof, and the positional relationship between these engaging members is designed to automatically connect the female terminal portions and the male terminal portions to each other when both the engaging members are engaged with each other.

Further, as described later, the female-side engaging member which is fixedly arranged on the flexible circuit board and which has second through-holes that are larger in diameter than first through-holes of the female terminal portions functions as fixing means adapted to fix portions of the flexible circuit board positioned in the respective vicinities of the female terminal portions.

Either one of the female-side engaging member and the male-side engaging member or both thereof are, as described later, provided with a function to position and guide both the engaging members at engaging time between both the engaging members and a retaining function to firmly retain both the engaging members after the engaging members are engaged with each other, thereby stabilizing a connection state between the female terminal portions and the male terminal portions.

In the case of connector structures A and B, when the female-side engaging member is engaged with the male-side engaging member by exerting the positioning and guiding function, elastically deformable portions of the female-side engaging member are elastically deformed, and brought into pressure contact with the male-side engaging member by causing elastic force (restoring force) based on the elastic deformation, so that the female-side engaging member is firmly held by the male-side engaging member. At the same time, the female terminal portions and the male terminal portions are connected to each other, and the connection state at the connecting portions is retained so that a conduction structure is formed.

Further, in the case of a connector structure C, when column-shaped projections (male-side engaging members) of a male connector are inserted into guide holes of the female-side engaging member of a female connector and they are pressed together, the female terminal portions and the male terminal portions are connected to each other, and simultaneously the female connector and the male connector are bonded/fixed to each other via a layer of adhesive agent, so that the connection state in the conduction structure formed is firmly retained.

Hereinafter, the connector structures according to the invention of the present application will be explained in detail with reference to the drawings.

First Embodiment

First, the connector structure A will be explained.

Figure 2:
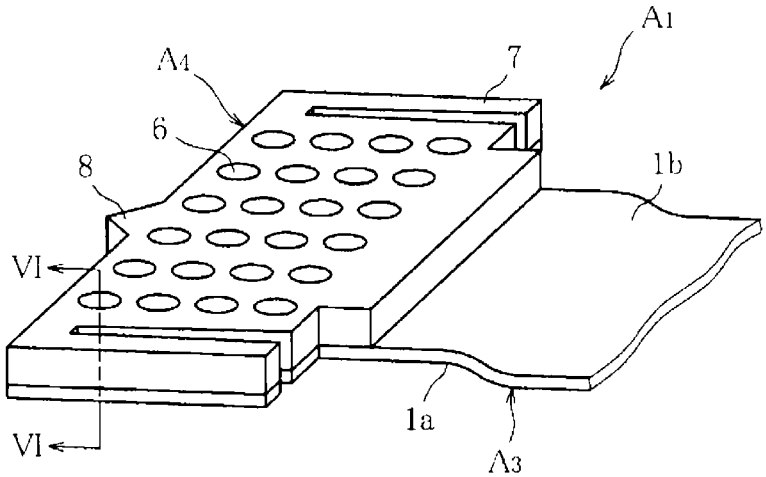
FIG. 2 is a perspective view showing a female connector $A_1$ in the connector structure A.
Figure 3:
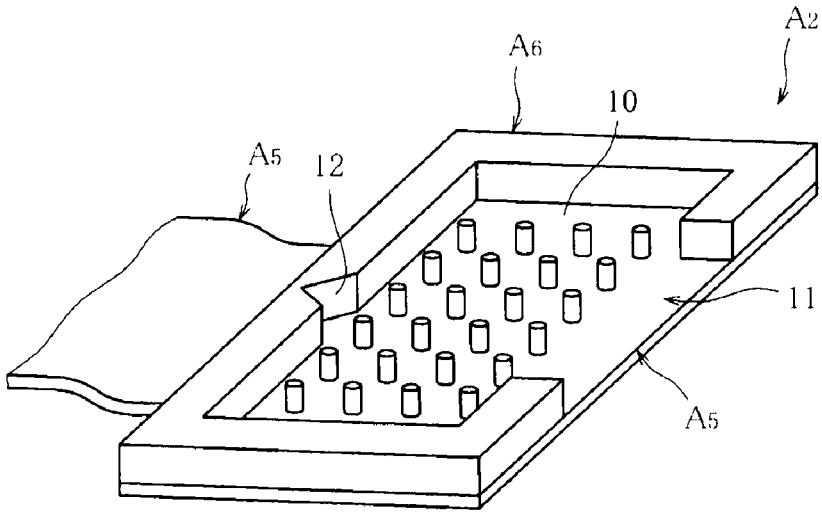
FIG. 3 is a perspective view showing a male connector $A_2$ in the connector structure A.

FIG. 1 is a perspective view showing the connector structure A, FIG. 2 is a perspective view showing a female connector $A_1$, and FIG. 3 is a perspective view showing a male connector $A_2$. The connector structure A is constructed by assembling the female connector $A_1$ and the male connector $A_2$ to each other in a manner described later.

Figure 4:
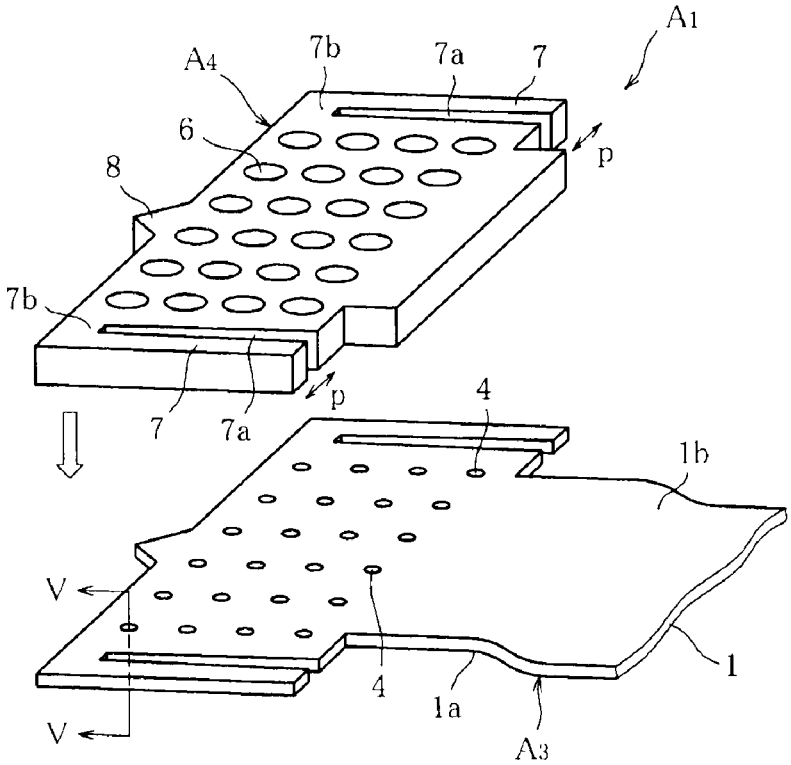
FIG. 4 is an exploded perspective view of the female connector $A_1$.

Here, as shown in FIG. 4 that is an exploded perspective view of the female connector shown in FIG. 2, the female connector $A_1$ has a structure in which a female-side engaging member $A_4$ is fixedly arranged on the opposite face of a flexible circuit board $A_3$ from a formation face of pad portions described later.

Figure 5:
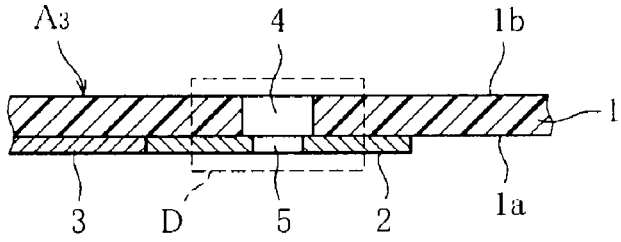
FIG. 5 is a sectional view taken along line V-V in FIG. 4.

Here, as shown in FIG. 5 that is a sectional view taken along line V-V in FIG. 4, the flexible circuit board $A_3$ is provided with a female terminal portion D comprising a flexible thin insulating film 1, a pad portion 2 formed at a predetermined position on a bottom face 1*a* of the insulating film 1, a conductor circuit pattern 3 drawn from an edge portion of the pad portion 2 and printed to a back face 1*a* of the insulating film 1, a first through-hole 4 formed in a thickness direction of the insulating film 1 within the face of the pad portion 2, and a small hole 5 formed coaxially with the first through-hole 4 within the face of the pad portion 2.

A plurality of (24 in a matrix in FIG. 4) such female terminal portions D are formed so as to maintain a positional relationship connectable with connecting pins of the male connector described later. Incidentally, FIG. 5 shows a case that the small hole 5 is smaller in diameter than the first through-hole 4, but the small hole 5 and the first through-hole 4 may have the same diameter.

As the insulating film 1 that is a base member of the flexible circuit board $A_3$, for example, a film made from resin such as polyimide, polyester, liquid crystal polymer, or polyether ether ketone, a thin glass epoxy composite plate, or a BT resin plate can be used. For the purpose of height reduction of the connector structure, the thickness of the insulating film 1 is preferably as thin as possible as long as it maintains mechanical strength.

As a material of the pad portion 2, as described later, in view of formation of the conduction structure between the female connector and the male connector due to pressure contact of the pad portion with the connecting pin of the male connector at the time of connection to the male connector, a material having spring elasticity as well as conductivity is preferred, in particular, copper, nickel, stainless steel, nickel alloy, or beryllium copper alloy is preferred. Considering that the pad portion exerts good spring elasticity, the thickness of the pad portion 2 is preferably not very thick, and the upper limit thereof is preferably set at about 100 μm.

When the flexible circuit board $A_3$ is manufactured, for example, a one-side copper-clad film is prepared, photolithography and etching techniques are applied to a surface of the one-side copper-clad film positioned on the side of a copper foil thereof to, while leaving portions of the copper foil where the pad portions 2 are to be formed and the conductor circuit patterns 3 are to be printed, remove the remaining portion of the copper foil, then the first through-holes 4 having a predetermined diameter are formed just on top of the respective pad portions 2 by performing irradiation of laser light to the one-side copper-clad film from the opposite face of the film from the formation face of the pad portions 2, and subsequently, the small holes 5 coaxially communicating with the first through-holes 4 are formed within the faces of the pad portions 2 by masking portions of the surface, positioned on the side of the pad portions 2, of the film other than portions of the film in which the small holes 5 are to be formed and then performing etching process of copper thereon.

Incidentally, when the pad portion 2 is formed from the afore-mentioned alloy material having excellent spring elasticity, the pad portion may be formed by also removing the copper foil of the pad portion to be formed at the etching removal time of the copper foil from the one-side copper-clad film to expose a film face, and sputtering the alloy material onto the film face.

Then, as shown in FIG. 4, the female-side engaging member $A_4$ is fixedly arranged on the opposite face 1*b* of the flexible circuit board $A_3$ from a formation face 1*a* of the pad portions 2, and thus the female connector $A_1$ shown in FIG. 2 is assembled.

Incidentally, the flexible circuit board used in the connector structure according to the present invention is not limited to a one-side circuit board such as described above but may be, for example, a flexible double-sided circuit board on both faces of which the pad portions 2 described above are formed or the side of a flexible circuit board of a flexible-rigid multilayered circuit board. Further, a coverlay may be applied to the conductor circuit pattern 3.

Next, the female-side engaging member $A_4$ will be explained.

The female-side engaging member $A_4$, first, functions as fixing means adapted to fix portions of the insulating film 1 of the flexible circuit board that are positioned in the vicinities of the female terminal portions D, when the female connector $A_1$ and the male connector $A_2$ are connected to each other.

Unless the female-side engaging member $A_4$ is fixedly arranged, the flexible circuit board $A_3$ is put in a state shown in FIG. 5, and this state shows a state that the female terminal portion D and the vicinity thereof are likely to move in a floating manner in vertical and horizontal directions. Therefore, when the female connector formed with the female terminal portions D widely distributed within the face of the insulating film 1 is connected to the male connector, both the connectors are not normally connected to each other in some cases, even though connections of the connecting pins and the female terminal portions D are realized in some areas, because the vicinities of the female terminal portions D are flexed and the positions of the centers of the first through-holes of the female terminal portions D and the positions of the axial centers of the connecting pins are deviated from each other.

However, if the foil-like female-side engaging member $A_4$, such as shown in FIG. 4, is fixedly arranged on the flexible circuit board A3, all the vicinities of the female terminal portions are put in states integrated with the female-side engaging member $A_4$, and therefore floating movement in the vertical direction or in the horizontal direction does not occur. As a result, two-dimensional position coordinates of the first through-holes 4 of the female terminal portions D are fixed at design reference values, so that positional deviation from the connecting pins does not occur.

In this manner, the female-side engaging member $A_4$ functions as fixing means adapted to fix the portions of the flexible circuit board positioned in the vicinities of the female terminal portions D, and simultaneously, it functions as a supporting member for facilitating assembling workability, ensuring strong retaining force between both the connectors, and supporting and protecting connector connecting portions in the thin flexible circuit board A1, when the female connector $A_1$ and the male connector $A_2$ are assembled to each other.

As a constituent material of the female-side engaging member $A_4$, considering that, when the female connector and the male connector are assembled to each other, the member $A_4$ functions as a member which prevents the positional deviation due to flexion of the vicinity of the female terminal portion D in the flexible circuit board $A_1$ to f ix the vicinity, and which engages with the male-side engaging member to retain both the connectors with high retaining force, a metal material having high strength and rigidity, for example, copper, iron, nickel, stainless steel, aluminum, or one of these materials whose surfaces have been plated is preferred.

Further, a sheet made of resin such as polyimide, polyester, polyether ether ketone, liquid crystal polymer, polyamide, or PEN, a fiber-reinforced plastic composite material sheet such as a glass fiber-epoxy resin sheet, or a laminated sheet of these materials can be used.

If the thickness of the sheet is too thin to be strong enough, the female-side engaging member $A_4$ is flexed at an engaging time with the male-side engaging member, causing difficulty in engaging work, or if the thickness of the sheet is too thick, the reduction in heights of the connecting portions is obstructed. Therefore, the thickness of the sheet is preferably set at about 50 to 300 μm.

The female-side engaging member $A_4$ is a foil-like body having the same two-dimensional shape as a formation portion of the female terminal portion D in the flexible circuit board $A_3$ in which the female terminal portions D are formed, and within the face of the female-side engaging member $A_4$, it has second through-holes 6 formed in a thickness direction thereof and a pair of elastically deformable portions 7, 7 formed on both side portions thereof.

The entire two-dimensional shape of the female-side engaging member $A_4$ is so formed as to be received in a receiving portion 10 of the male-side engaging member $A_6$ shown in FIGS. 3 and 8 described later.

The second through-hole 6 is formed coaxially with the first through-hole 4 in the female terminal portion D of the flexible circuit board $A_3$ shown in FIG. 5, and it is larger in diameter than the first through-hole 4.

Figure 6:
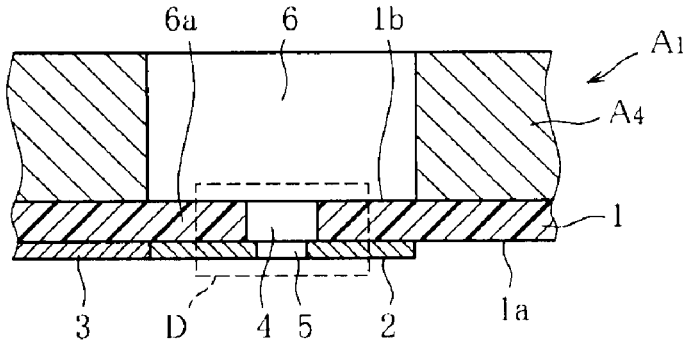
FIG. 6 is a sectional view taken along line VI-VI in FIG. 2.

Therefore, in the female terminal portion D of the female connector $A_1$ shown in FIG. 2 that is formed by disposing the female-side engaging member $A_4$ fixedly on the flexible circuit board $A_3$, as shown in FIG. 6 that is a sectional view taken along line VI-VI in FIG. 2, the second through-hole 6 that is larger in diameter than the first through-hole 4 is coaxially positioned on top of the first through-hole 4, so that a shelf-like portion 6*a* which comprises the insulating film 1 and the pad portion 2 and which extends in a direction of the central axis of the second through-hole 6 is formed inside the second through-hole 6.

The shelf-like portion 6*a* is a vertically-bendable flexible portion, but a portion of the insulating film 1 that is positioned outside the shelf-like portion 6*a* is integrated with the female-side engaging member $A_4$ fixedly arranged and it is fixed in a state that it cannot move in a floating manner or cannot flex.

The elastically deformable portions 7, 7 formed on both side portions of the female-engaging member $A_4$ are elastically deformed when the female connector and the male connector are assembled to each other, and the female-side engaging member $A_4$ comes into pressure contact with the male-side engaging member owing to elastic force (restoring force) thereof, thereby securing the retaining force between both the connectors.

The elastically deformable portions 7 of the female-side engaging member $A_4$ in FIG. 4 are spring arm portions formed by forming slits 7*a*, 7*a* having a wedge-shaped two-dimensional shape and a width narrower in a longitudinal direction of the foil-like body on both side portions of the foil-like body, and they are put in a state that they can be flexed in a direction indicated by arrows p in FIG. 4 by utilizing portions 7*b*, 7*b* in which the slits 7*a* are not formed as fulcrum points.

Incidentally, a projecting portion 8 projecting outward is formed at a central position of the female-side engaging member $A_4$ in a widthwise direction thereof, and corresponding to the projecting portion 8, a recessed portion 12 whose two-dimensional shape is triangular to conform to the shape of the projecting portion 8 and fit the projecting portion 8 (see FIGS. 3 and 8) is formed at a central position of the male-side engaging member $A_6$ described later in a widthwise direction thereof.

It is preferred that the projecting portion 8 that is fitted in the recessed portion 12 is formed in advance, because, by using the projecting portion 8 as a mark to align the projecting portion 8 with the recessed portion 12, fitting both the portions to each other, and then pushing the female-side engaging member $A_4$ into the male-side engaging member $A_6$, engaging work between the female-side engaging member $A_4$ and the male-side engaging member $A_6$ can be performed smoothly in a state that both the members have been positioned to each other.

When the female-side engaging member $A_4$ is fixedly arranged on the flexible circuit board $A_3$, it is possible to manufacture the female-side engaging member $A_4$ having the shape shown in FIG. 4 as a separated member in advance by applying, for example, photolithography and etching technique to a stainless steel foil-like body or performing punching process or the like thereon, and then bond the foil-like body to the flexible circuit board $A_3$ formed in the same shape in plan view as the female-side engaging member $A_4$ by using adhesive agent such as sticky adhesive agent, thermosetting adhesive agent, or hot-melt adhesive.

Further, prior to formation of the female-side terminal portions D of the flexible circuit board $A_3$, it is possible to conform the two-dimensional shape of the flexible circuit board to that of a targeted female-side engaging member $A_4$, then form a thin layer of a metal material by applying known nonelectrolytic plating and electrolytic plating to the opposite face of the insulating film from the face of the pad portions in the board, then form the second through-holes by application of photolithography and etching techniques, and thereafter manufacture the female terminal portions on the board.

Figure 7:
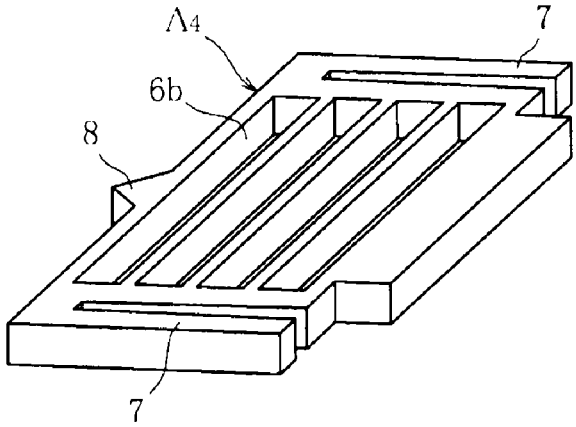
FIG. 7 is a perspective view showing another example of a female-side engaging member $A_4$.

Incidentally, the above explanation has been made about the female-side engaging member $A_4$ in which one second through-hole 6 is formed per one female terminal portion D of the flexible circuit board $A_3$, but, as the female-side engaging member, for example, as shown in FIG. 7, a female-side engaging member $A_4$ in which grooves 6*b* that can collectively receive all the second through-holes 6 shown in FIG. 4 in the longitudinal direction or the widthwise direction (widthwise direction in FIG. 7) are formed may be used. This is because, in this case, the portions of the flexible circuit board positioned in the vicinities of the female terminal portions D are also fixed by portions of the female-side engaging member $A_4$ except the grooves 6*b* so as not to be flexed vertically or horizontally. In this case, it is also preferable that the groove width of the groove 6*b* is larger than the diameter of the first through-hole of the flexible circuit board $A_3$.

Next, the male connector $A_2$ shown in FIG. 3 will be explained.

Figure 8:
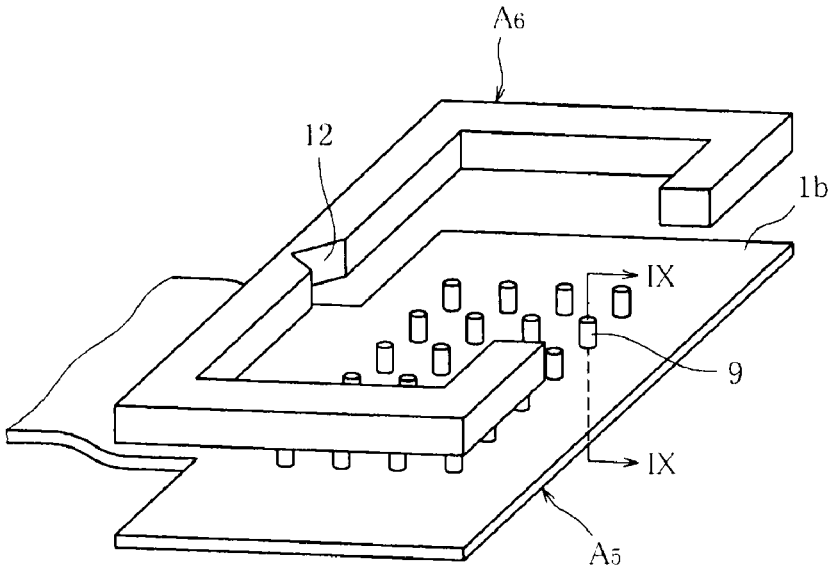
FIG. 8 is an exploded perspective view of the male connector $A_2$.

As shown in FIG. 8 that is an exploded perspective view of FIG. 3, the male connector $A_2$ has a structure in which the male-side engaging member $A_6$ is fixedly arranged on the same face of a circuit board $A_5$ as a formation face of the connecting pins described later.

Here, as the circuit board $A_5$, a flexible circuit board such as shown in FIG. 4 may be used, or a rigid circuit board whose insulating member is made from, for example, a glass fiber-epoxy resin composite, may be used.

Incidentally, the following explanation is made on the assumption that the circuit board $A_5$ is a flexible circuit board.

Figure 9:
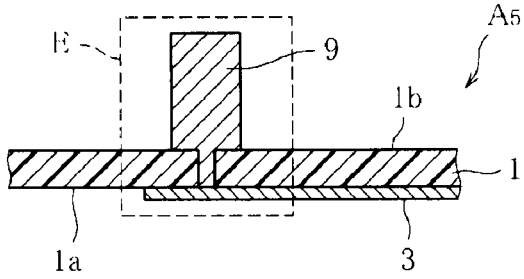
FIG. 9 is a sectional view taken along line IX-IX in FIG. 8.

As shown in FIG. 9 that is a sectional view taken along line IX-IX in FIG. 8, the flexible circuit board $A_5$ is provided with a male terminal portion E comprising an insulating member that is a thin insulating film 1 having flexibility, a connecting pin 9 formed on one face of the insulating film 1 in a projected manner, and a conductor circuit pattern 3 that is drawn from a proximal portion of the connecting pin 9 and printed to the other face 1*a* of the insulating film 1.

When the connector structure A shown in FIG. 1 is assembled by assembling the female connector $A_1$ shown in FIG. 2 and the male connector $A_2$ shown in FIG. 3 to each other, the connecting pins 9 in the male terminal portions E described above are inserted in the first through-holes 4 from the small holes 5 in the female terminal portions D of the female connector $A_1$, so that a conduction structure between both the connectors is formed.

Therefore, such male terminal portions E are so formed as to maintain a positional relationship corresponding to a plurality of female terminal portions D in the first flexible circuit board $A_3$ of the female connector $A_1$, respectively, when the female connector $A_1$ and the male connector $A_2$ are assembled to each other.

The connecting pin 9 projecting from a surface of the circuit board $A_5$ is larger in diameter than the small hole 5 and the first through-hole 4 of the female terminal portion D of the female connector $A_1$, and smaller in diameter than the second through-hole 6 of the female-side engaging member $A_4$. Further, it is preferable that the height of the connecting pin 9 is set such that a distal end portion of the connecting pin 9 does not project from the second through-hole 6 when the connecting pin 9 is inserted into the female terminal portion D. This is because the connecting pin can be prevented from being damaged, and can be protected, after both the connectors are assembled to each other.

When the circuit board $A_5$ is manufactured, if the circuit board $A_5$ is a flexible circuit board, for example, a one-side copper-clad film is prepared, and the connecting pin 9 provided on the surface 1*b* of the insulating film 1 in a projected manner, such as shown in FIG. 9, is formed by applying photolithography and etching technique to a copper foil of the film to form a desired conductor circuit pattern 3, then, for example, performing laser irradiation to a spot at which the connecting pin is formed on the opposite face of the film to form a recess that reaches the conductor circuit, further performing nonelectrolytic plating and electrolytic plating after masking the portions other than the recess to a thickness equal to the height of the connecting pin to be formed, thereby filling the recess and a hole formed in the mask with, for example, plating copper, and finally removing the mask.

Incidentally, the connecting pin 9 is slid on the pad portion 2 when being inserted into the female terminal portion D, so that, as a material of the connecting pin 9, a relatively hard metal such as copper, nickel, gold, palladium, rhodium, or silver, or alloy is preferably used.

The male-side engaging member $A_6$ such as shown in FIG. 8 is fixedly arranged on the flexible circuit board $A_5$, so that the male connector $A_2$ shown in FIG. 3 is assembled.

As shown in FIG. 8, the male-side engaging member $A_6$ is a frame-like body that partially surrounds outsides of the connecting pins 9 arranged on the surface 1*b* of the flexible circuit board $A_5$ in a projected manner, and, when the male-side engaging member $A_6$ is fixedly arranged on the flexible circuit board $A_5$, the receiving portion 10 having a two-dimensional shape that can receive the entire female connector $A_1$ shown in FIG. 2 is formed within the frame, as shown in FIG. 3, and a notch portion for drawing 11 that draws the flexible circuit board $A_3$ extending from the female terminal portions D of the female connector $A_1$ beyond the frame is also formed.

Incidentally, as described above, the recessed portion 12 for fitting the projecting portion 8 of the female-side engaging member $A_4$ shown in FIG. 4 therein is formed at the center in a widthwise direction of the inside of the frame-like body that is the male-side engaging member $A_6$.

Figure 10:
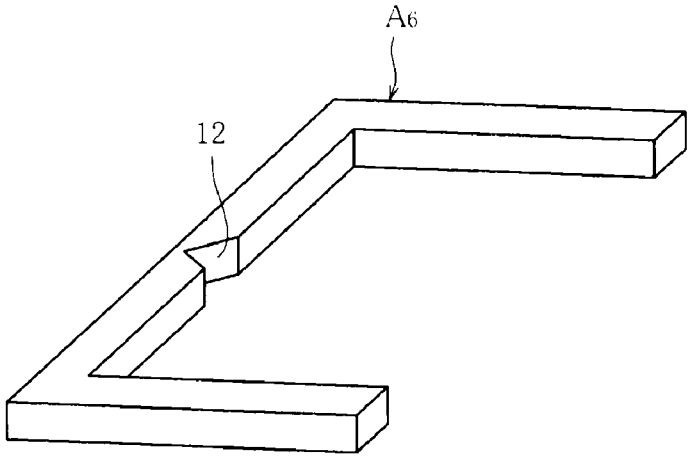
FIG. 10 is a perspective view showing another example of a male-side engaging member $A_6$.

Incidentally, the shape of the male-side engaging member is not limited to the shape shown in FIG. 8, but, for example, as shown in FIG. 10, the male-side engaging member may be formed in a perfect gate shape.

When the male-side engaging member $A_6$ is fixedly arranged on the circuit board $A_5$, it is possible to produce the frame-like body as a separated member in advance, and then bond it to the circuit board $A_5$ with adhesive agent such as sticky adhesive agent, thermosetting adhesive agent, or hot-melt adhesive agent, or it is also possible to form it by plating technique simultaneously when the connecting pins 9 are formed in the manufacturing process of the circuit board $A_5$.

As a material of the male-side engaging member $A_6$, various metal materials or resin materials similar to those of the female-side engaging member $A_4$ can be proposed, but a metal material such as stainless steel is preferred for the same reason described above as in the case of the female-side engaging member $A_4$. It is preferable that the thickness of the male-side engaging member $A_6$ is also set at about 50 to 300 μm for the same reason as in the case of the female-side engaging member $A_4$.

When the connector structure A of the present invention shown in FIG. 1 is assembled, it is possible to fit the projecting portion 8 of the female connector $A_1$ shown in FIG. 2 into the recessed portion 12 of the male connector $A_2$ shown in FIG. 3, thereafter push and flex the spring arm portions 7 on both side portion of the female connector $A_2$ in the widthwise direction, simultaneously push and fit the entire female connector $A_1$ into the receiving portion 10 of the male connector $A_2$, and then release the spring arm portions 7 from the pushing thereof. The female connector $A_1$ is received within the receiving portion 10 of the frame-like body (male-side engaging member $A_6$) of the male connector $A_2$ in a state that the flexible circuit board $A_3$ of the female connector $A_1$ has been drawn from the notch portion for drawing 11 of the male connector $A_2$.

Figure 11:
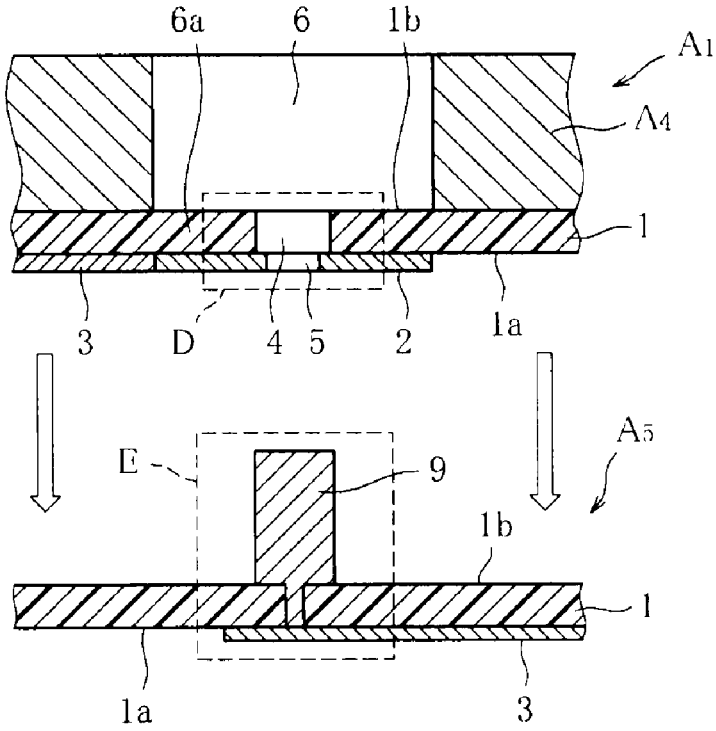
FIG. 11 is a sectional view showing a state that a male terminal portion E of a circuit board $A_5$ in the male connector $A_2$ is connected to a female terminal portion D of a flexible circuit board $A_3$ in the female connector $A_1$.

At this time, as shown in FIG. 11, the connecting pin 9 of the male terminal portion E that is formed on the circuit board $A_5$ of the male connector $A_2$ is inserted into the first through-hole 4 and the second through-hole 6 of the female-side engaging member $A_4$ that is positioned just on top of the first through-hole 4 through the small hole 5 from the formation face of the pad portion 2 in the female terminal portion D that is formed on the flexible circuit board $A_3$ of the female connector $A_1$.

Then, since the small hole 5 and the first through-hole 4 of the female terminal portion D are smaller in diameter than the connecting pin 9, the small hole 5 and the first through-hole 4 are diametrically expanded in the course of insertion of the connecting pin 9, and simultaneously portions of the pad portion 2 and of the insulating film 1 positioned on top thereof, namely, the shelf-like portion 6*a* is flexed upward and elastically deformed.

Figure 12:
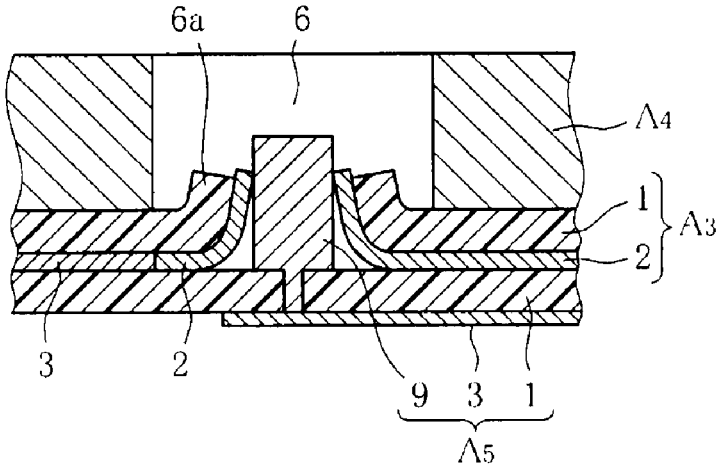
FIG. 12 is a sectional view showing a pressure contact state of a pad portion of the female connector with a connecting pin of the male connector.

As a result, since elastic force (restoring force) of the pad portion 2 and the insulating film 1 is generated, as shown in FIG. 12, the pad portion 2 is brought in pressure contact with a side portion of the connecting pin 9 so that both the circuit boards are mechanically connected to each other, and simultaneously a conduction structure is formed between the flexible circuit board $A_3$ and the circuit board $A_5$.

At this time, since a portion of the insulating film 1 that is positioned in the vicinity of each female terminal portion, namely, a portion of the insulating film 1 that is positioned outside the shelf-like portion 6*a* is integrally fixed to the female-side engaging member $A_4$ made of a rigid material of high strength, the portion is not flexed vertically or horizontally in the course of the assembling described above. Therefore, the positions of the hole centers of the first through-holes 4 in all the female terminal portions D are not deviated from their design reference points. As a result, all the first through-holes 4 and the connecting pins 9 corresponding thereto can be collectively connected to each other at once without causing positional deviation.

Figure 13:
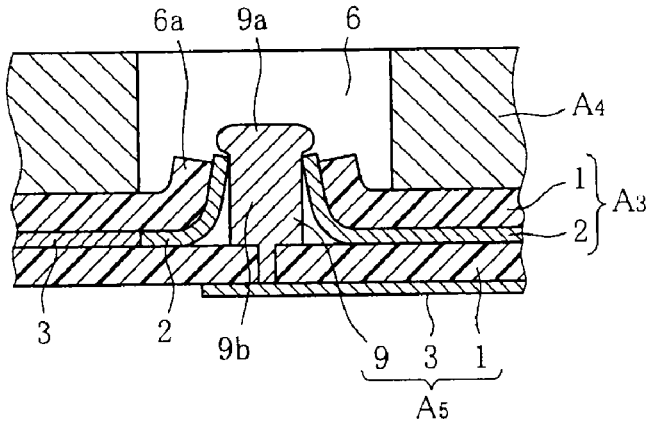
FIG. 13 is a sectional view showing another pressure contact state.

In the pressure contact structure of the pad portion and the connecting pin with each other, as shown in FIG. 13, it is preferred that a peripheral edge of a distal end portion 9*a* of the connecting pin 9 bulges so as to be larger in diameter than a side portion 9*b* on a proximal side thereof, because escape of the connecting pin 9 from the small hole 5 and the first through-hole 4, namely, separation of the flexible circuit board $A_3$ and the circuit board $A_5$ from each other can reliably be prevented.

Figure 14:
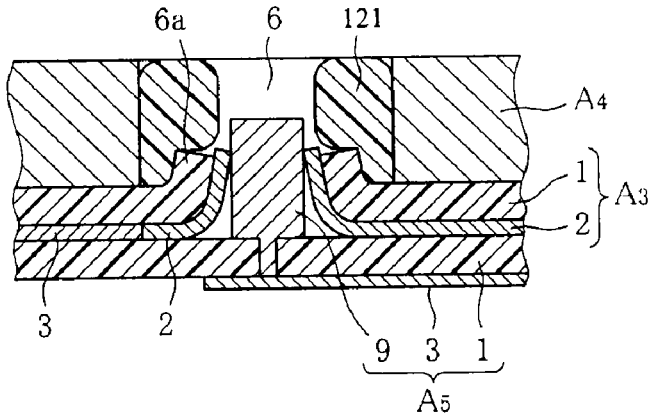
FIG. 14 is a sectional view showing still another pressure contact state.

Further, if, prior to assembling the female connector and the male connector to each other, an annular resin elastic body 121 having the same inner diameter as the first through-hole 4 and the same outer diameter as the second through-hole 6 is arranged on the shelf-like portion 6*a* in the second through-hole formed in the female-side engaging member $A_4$ of the female connector, as shown in FIG. 14, the resin elastic body 121 receives compressive force due to upward flexion of the shelf-like portion 6*a* accompanying the insertion of the connecting pin 9 to be elastically deformed and the pad portion 2 is brought in pressure contact with the side portion of the connecting pin 9 by restoring force of the resin elastic body after both the connectors have been connected to each other. As a result, the connecting pin 9 can reliably be prevented from escaping, and simultaneously reliability of the conduction structure between both the circuit boards is improved.

As such a resin elastic body, cured silicone resin is preferred, particularly, one whose rubber hardness degree specified by JIS K 6253 is equal to or less than 100 degrees is preferred.

Figure 15:
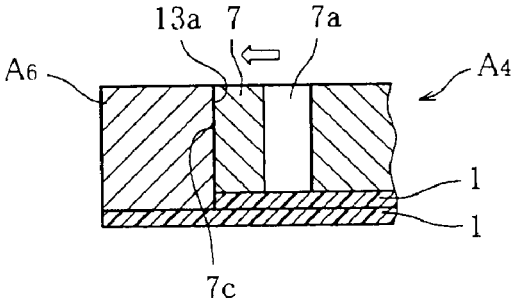
FIG. 15 is a sectional view showing a pressure contact state of a spring arm portion of the female-side engaging member and an inner wall face of the male-side engaging member.

In the connector structure A in FIG. 1, as shown in FIG. 15 that is a sectional view taken along line XV-XV in FIG. 1, the female-side engaging member $A_4$ of the female connector and the male-side engaging member $A_6$ of the male connector are engaged with each other by bringing outer wall faces 7*c* of the spring arm portions 7 formed on both the sides of the female-side engaging member $A_4$ into pressure contact with inner wall faces 13*a* on both the sides of the male-side engaging member (frame-like body) $A_6$.

That is, as shown in FIG. 4, since the spring arm portions 7 are formed by providing the wedge-shaped slits 7*a* extending to the fulcrums 7*b* in the longitudinal direction on both the sides of the integrated combination of the foil-like body (female-side engaging member) $A_4$ and the flexible circuit board $A_3$, they can be flexed about the fulcrums 7*b* like plate springs in the widthwise direction of the foil-like body.

Further, since the spring arm portions 7 are pushed toward the center of the width of (to the inside of) the female-side engaging member $A_4$ when the female-side engaging member $A_4$ of the female connector $A_1$ is received in the male-side engaging member (frame-like body) $A_6$ of the male connector $A_2$ to engage them with each other, the spring arm portions 7 are flexed inward and elastically deformed, so that, after the reception, spring forces stored in the spring arm portions 7 act outward (direction indicated by arrows in FIG. 15) about the fulcrums 7*b*. As a result, the outer wall portions 7*c* of the spring arm portions 7 of the female-side engaging member $A_4$ are brought in pressure contact with the inner wall faces 13*a* of the frame-like body, and thus the female-side engaging member $A_4$ is held within the frame of the male-side engaging member (frame-like body) $A_6$.

In order to obtain a connector structure that is not separated at the connecting portions even if it is subjected to vibrations or an impact, it is possible to increase the above-mentioned retaining force. In order to meet such a requirement, the following structure is preferably adopted.

Figure 16:
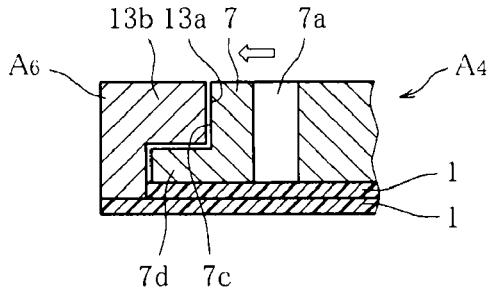
FIG. 16 is a sectional view showing another pressure contact state of a spring arm portion of the female-side engaging member and an inner wall face of the male-side engaging member.

That is, as shown in FIG. 16, it is preferable that the outer wall face 7*c* of the spring arm portion 7 of the female-side engaging member $A_4$ is stepped to form a projecting portion 7*d* on a lower portion thereof, while the inner wall face 13*a* of the male-side engaging member $A_6$ is stepped to form a projecting portion 13*b* on an upper portion thereof.

When the female-side engaging member $A_4$ and the male-side engaging member $A_6$ are engaged with each other, the projecting portion 7*d* of the outer wall face of the spring arm portion 7 gets under the projecting portion 13*b* of the inner wall face of the male-side engaging member $A_6$, and therefore the retaining force between both the members is much larger than the retaining force in the structure shown in FIG. 15, so that they are reliably engaged with each other without being separated from each other.

Second Embodiment

Next, the connector structure B of the present invention will be explained.

Figure 17:
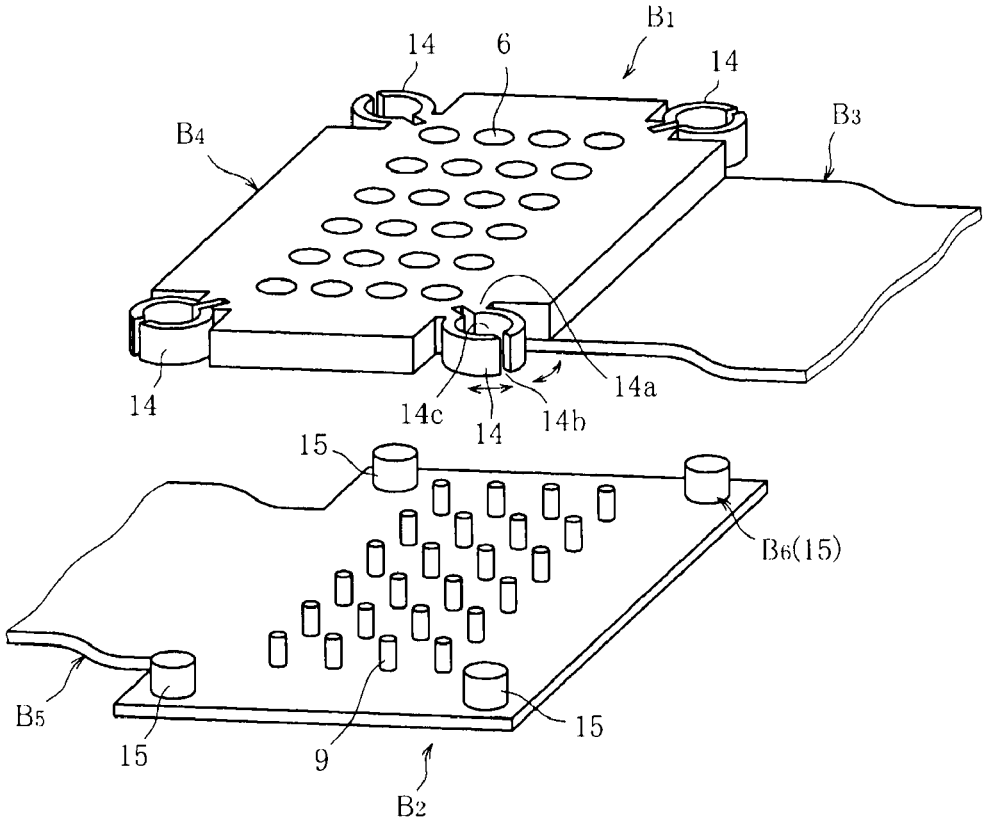
FIG. 17 is an exploded perspective view showing a connector structure B of the present invention.

FIG. 17 is an exploded perspective view of the connector structure B. The connector structure B is constructed by assembling a female connector $B_1$ and a male connector $B_2$ to each other.

The female connector $B_1$ comprises a flexible circuit board $B_3$ having the same structure as the flexible circuit board $A_3$ in the connector structure A and a female-side engaging member $B_4$ fixedly arranged on the opposite face of the flexible circuit board $B_3$ from the formation face of the pad portions.

Incidentally, the female-side engaging member $B_4$ also functions as fixing means adapted to fix portions of the insulating film of the flexible circuit board positioned in the vicinities of the female terminal portions D in the flexible circuit board $B_3$, as in the case of the female-side engaging member $A_4$ of the connector structure A.

On the other hand, the male connector $B_2$ comprises a circuit board $B_5$ having the same structure as the circuit board $A_5$ in the connector structure A and male-side engaging members $B_6$ fixedly arranged at four corners of the same face as the formation face of the connecting pins 9 of the circuit board $B_5$ in a predetermined positional relationship with the connecting pins 9.

First, the female-side engaging member $B_4$ is the same as the female-side engaging member $A_4$ of the connector structure A in that it is a foil-like body and that the second through-holes 6 are formed within the face thereof coaxially with the small holes and the first through-holes of the female terminal portions of the flexible circuit board $B_3$, but different therefrom in that the elastically deformable portions are notch ring bodies 14 formed integrally at the four corners of the foil-like body.

Figure 18:
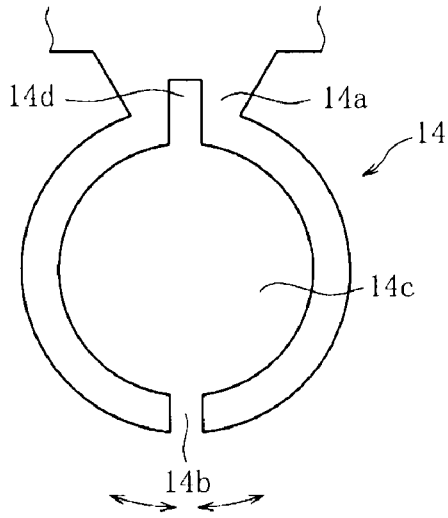
FIG. 18 is a plan view showing a notch ring body.

As shown in FIGS. 17 and 18, the notch ring body 14 is equal in thickness to the foil-like body, and formed integrally with the foil-like body. A notch portion 14*b* having a desired width is formed by slitting an annular portion positioned outside a proximal portion 14*a* of the notch ring body 14, and a notch 14*d* is also formed in the proximal portion 14*a*. Therefore, in the notch ring body 14, the notch portion 14*b* can be opened and closed about the proximal portion 14*a* by elastically deforming ring portions formed in a semi-circular shape on both sides of the notch ring body 14, as indicated by arrows in FIG. 18. The diameter of a ring hole 14*c* of the notch ring body 14 allows the male-side engaging member $B_6$ to be inserted therein.

For such a reason, as a material of the female-side engaging member $B_4$, a highly-elastic material is preferred, and specifically the same material as that of the female-side engaging member $A_4$ of the connector structure A, for example, stainless steel is preferred.

Then, the female-side engaging member $B_4$ is fixedly arranged on the flexible circuit board $B_3$ in a similar manner to that in the case of the female-side engaging member $A_4$ of the connector structure A.

On the other hand, the male-side engaging members $B_6$ in the male connector $B_2$ are column-shaped projections 15.

The column-shaped projections 15 are formed at four spots on the male connector $B_2$, and they are formed at positions corresponding to the ring holes 14*c* of the notch ring bodies (elastically deformable portions) 14 of the female connector $B_3$ coaxially with the corresponding ring holes 14*c*. Further, the height of the column-shaped projection 15 is equal to or slightly larger than the thickness of the notch ring body 14, and the diameter thereof is larger than that of the ring hole 14*c*.

Therefore, since, when the column-shaped projections (male-side engaging members) 15 of the male connector $B_2$ are inserted into the ring holes 14*c* of the notch ring bodies (female-side engaging members) 14 of the female connector $B_1$, the ring holes 14*c* are diametrically expanded, the notch ring bodies 14 are elastically deformed, and, at this point, the connecting pins (male terminal portions E) 9 of the male connector 13, and the female terminal portions D of the female connector $B_1$ are positioned to each other. When the insertion of the column-shaped projections 15 into the notch ring bodies 14 is completed, the pad portions of the female terminal portions and the connecting pins of the male terminal portions are simultaneously connected to each other, as shown in FIG. 12 for the connector structure A, and thus the conduction structure is formed between both the circuit boards $B_3$, $B_5$.

Further, since the notch ring body 14 elastically deformed generates restoring force that restores the ring hole 14*c* diametrically expanded to its original inner diameter, the column-shaped projection 15 inserted is retained in pressure contact with the notch ring body 14.

Figure 19:
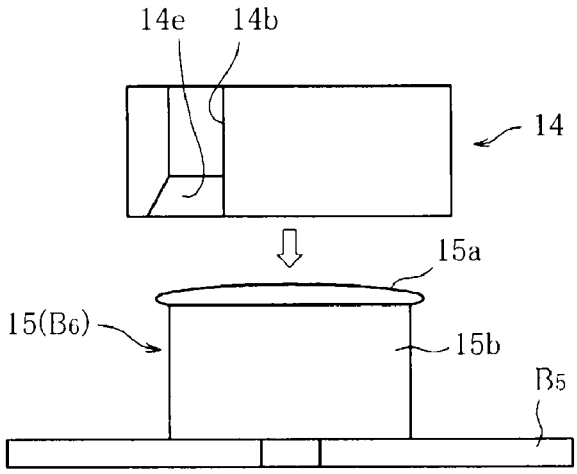
FIG. 19 is a schematic view showing a state that a female-side engaging member (notch ring body) and a male-side engaging member (column-shaped projection) of the connector structure B are engaged with each other.

At this time, as shown in FIG. 19, it is preferred that a distal end portion 15*a* of the column-shaped projection 15 is larger in diameter than a side portion 15*b*, the height of the side portion 15*b* is approximately equal to the thickness of the notch ring body 14, and a tapered face 14*e* whose lower end portion is larger in diameter than the distal end portion 15*a* of the column-shaped projection and whose upper end portion is positioned in an intermediate portion of the inner wall face of the notch ring body 14 is formed on an inner wall face of the notch ring portion 14 on the insertion side of the column-shaped projection, so that a positioning and guiding function is provided.

Figure 20:
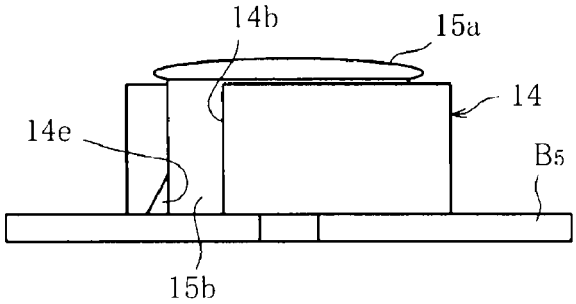
FIG. 20 is a schematic view showing a state that the column-shaped projection is held by the notch ring body.

According to such a configuration, when the column-shaped projection 15 is inserted into the notch ring body 14, as shown in FIG. 20, the distal end portion 15*a* of the column-shaped projection 15 projects from an upper end portion of the notch ring body 14, and the notch ring portion 14 is brought in pressure contact with the side portion 15*b* of the column-shaped projection 15. Therefore, the distal end portion 15*a* that is larger in diameter than the side portion 15*b* serves as a stopper, so that the column-shaped projection 15 is securely held by the notch ring body 14 without escaping from the notch ring body 14.

Incidentally, insertion of the column-shaped projection 15 into the notch ring body 14 can be smoothly performed, since the tapered face 14*e* described above is formed on the inner wall face of the notch ring portion 14.

Incidentally, in the connector structure shown in FIG. 17, the notch ring bodies 14 are formed at four corners of the female-side engaging member $B_4$, and the column-shaped projections 15 are formed at four corners of the male connector $B_2$ coaxially with corresponding notch ring bodies 14, so that a positioning and guiding function for the female-side engaging member and the male-side engaging member (column-shaped projections) is exerted, but spots at which the notch ring bodies 14 and the column-shaped projections 15 are formed and the respective numbers of notch ring bodies 14 to be formed and column-shaped projections 15 to be formed are not limited to those described above.

Figure 21:
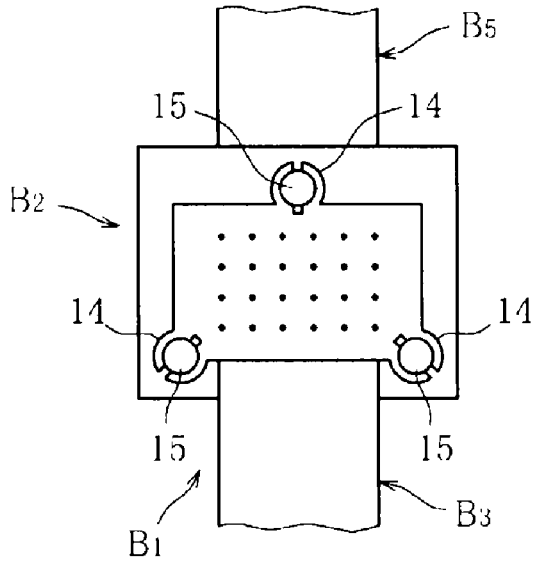
FIG. 21 is a plan view showing another connector structure B.
Figure 22:
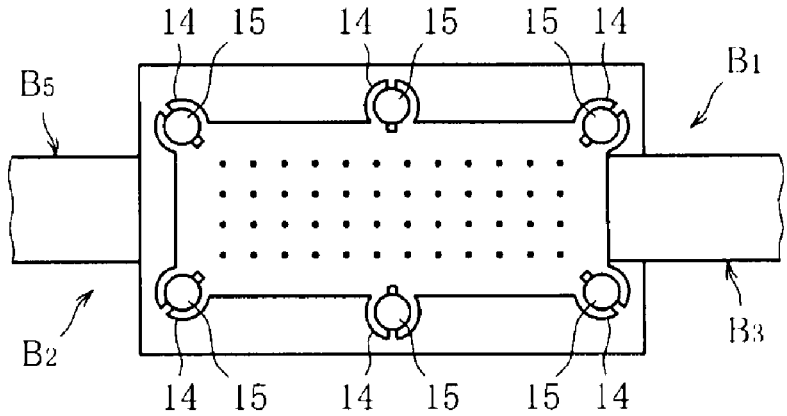
FIG. 22 is a plan view showing still another connector structure B.

For example, as shown in FIG. 21, a structure in which the female connector $B_1$ and the male connector $B_2$ are supported at three points may be adopted, or, if the number of connecting portions between the female terminal portions and the male terminal portions is increased, a structure in which the female connector $B_1$ and the male connector $B_2$ are supported at six points as shown in FIG. 22 or at more points may be adopted.

Third Embodiment

Next, the connector structure C according to the present invention will be explained.

Figure 23:
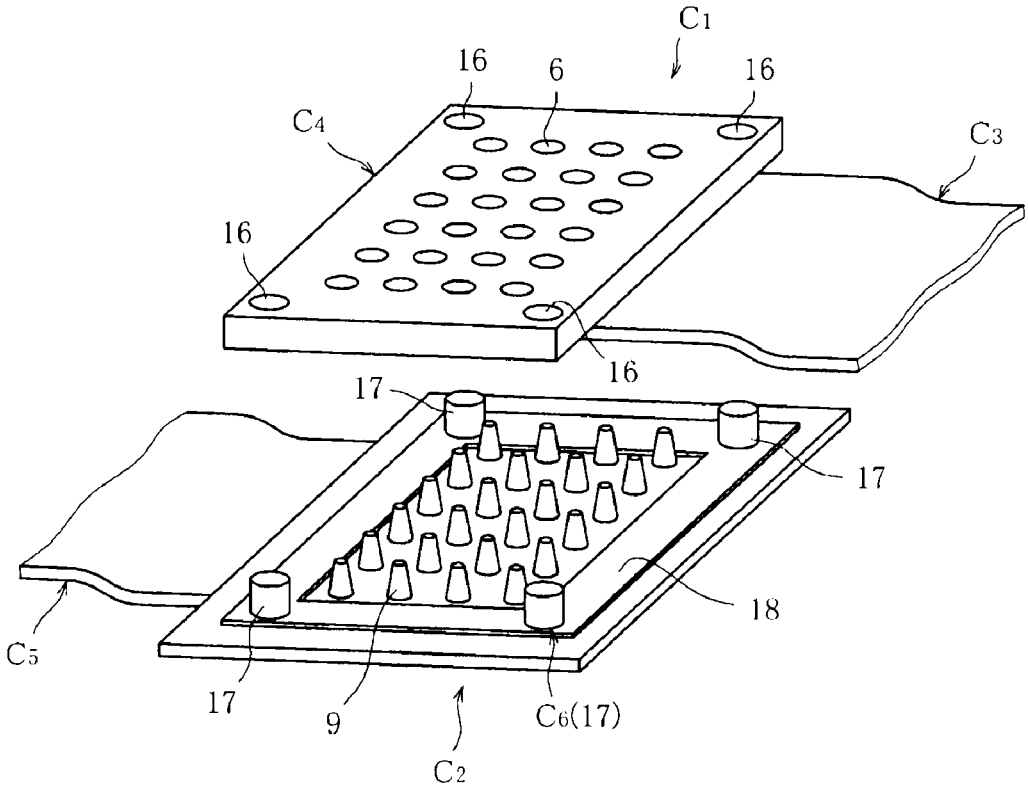
FIG. 23 is an exploded perspective view showing a connector structure C of the present invention.

FIG. 23 is an exploded perspective view of the connector structure C. The connector structure C is constructed by assembling a female connector $C_1$ and a male connector $C_2$ to each other.

The female connector $C_1$ comprises a flexible circuit board $C_3$ having the same structure as that of the flexible circuit board $A_3$ in the connector structure A and a female-side engaging member $C_4$ fixedly arranged on the opposite face of the flexible circuit board $C_3$ from the formation face of the pad portions.

Incidentally, the female-side engaging member $C_4$ also functions as fixing means adapted to fix portions of the insulating film of the flexible circuit board that are positioned in the vicinities of the female terminal portions D in the flexible circuit board $C_3$, as in the case of the female-side engaging member $A_4$ of the connector structure A.

On the other hand, the male connector $C_2$ comprises a flexible circuit board $C_5$ having the same structure as the circuit board $A_5$ in the connector structure A and male-side engaging members $C_6$ fixedly arranged at four corners of the same face as the connecting pins 9 of the flexible circuit board $C_5$ while a predetermined positional relationship with the connecting pins 9 is maintained.

First, the female-side engaging member $C_4$ in the female connector $C_1$ is the same as the female-side engaging member $A_4$ of the connector structure A in that it is a foil-like body and that it has the second through-holes 6 formed within the face thereof coaxially with the first through-holes of the female terminal portions of the flexible circuit board $C_3$, but different therefrom in that it is not provided with the elastically deformable portions such as the spring arm portions in the female-side engaging member $A_4$ (or the notch ring bodies in the female-side engaging member $B_4$ of the connector structure B) but guide holes 16 are formed at the four corners instead.

On the other hand, the male-side engaging members $C_6$ in the male connector $C_2$ are column-shaped projections 17, and are formed at corresponding formation spots of the guide holes 16 of the female-side engaging member $C_4$ coaxially with the guide holes 16 so as to be inserted thereinto. The column-shaped projections 17 and the guide holes 16 exert a positioning and guiding function in the connector structure C. A layer of adhesive agent 18 is formed on one face of the male connector $C_2$ that is opposite to the female connector $C_1$ except for an area thereof where the connecting pins 9 are arrayed (in FIG. 23, an area that surrounds the connecting pins 9).

The layer of adhesive agent 18 can be formed by such a method as printing an ultraviolet curable adhesive agent or attaching various adhesive sheets or thermo compression sheets.

Incidentally, the layer of adhesive agent is formed on the male connector $C_2$ in the connector structure shown in FIG. 23, but the layer of adhesive agent may be formed on a face of the female connector $C_1$ that is opposite to the male connector $C_2$, or it may be formed on both the male connector $C_2$ and the female connector $C_1$.

In any case, it is necessary to form the layer of adhesive agent in the entire or a partial area except for the area where the connecting pins are arrayed (when it is formed on the male connector $C_2$) or the entire or a partial area except for the area where the female terminal portions are arrayed (when it is formed on the female connector $C_1$). This is because, if the layer of adhesive agent is formed in the area where the connecting pins are arrayed or the area where the female terminal portions are arrayed, the conduction structure cannot be formed at the assembling time of both the connectors described later.

Therefore, when the column-shaped projections (male-side engaging members) 17 of the male connector $C_2$ are inserted into the guide holes 16 of the female-side engaging member $C_4$, all the connecting pins 9 are collectively inserted into the female terminal portions in a state that they have been positioned to the female terminal portions of the female connector $C_1$ and, when the female connector $C_1$ and the male connector $C_2$ are pressed and insertion of the connecting pins into the female terminal portions is completed as a whole, the conduction structure is formed in a state that the pad portions of the female terminal portions have been brought in pressure contact with the connecting pins of the male terminal portions. At the same time, the layer of adhesive agent 18 serves to bond the female connector $C_1$ and the male connector $C_2$ to each other so that both the connectors are integrated with each other.

That is, since the female connector $C_1$ and the male connector $C_2$ are bonded/fixed to each other via the layer of adhesive agent 18, though the connector structure C is not provided with the elastically deformable portions unlike the connector structures A and B, the connecting portions between the female terminal portions and the male terminal portions are firmly retained. However, the connector structure in this case does not have a repairable structure unlike the connector structures A and B. However, if adhesive agent containing acrylic oligomer and acrylic monomer as main components is used as the adhesive agent, the connector structures C can be retained in a repairable state.

Incidentally, the numbers of guide holes 16 and corresponding column-shaped projections 17 or the spots of formation thereof are not limited to those in the embodiment shown in FIG. 23, and it does not matter how many guide holes and column-shaped projections to form or where to form them, as long as they can exert the positioning and guiding function at the assembling time of the female connector and the male connector to each other.

Fourth Embodiment

The connector structures according to the present invention are largely reinforced in retaining force between the female connector and the male connector as compared with that in the connector structure described in Japanese Patent No. 4059522.

In order to further reinforce the retaining force to further increase the reliability of the connector structure in actual use, for example, the following structure can also be added at the assembling time of the female connector and the male connector.

The structure added to the connector structure A in which the female-side engaging member and the male-side engaging member are both foil-like bodies will be first explained.

In the case of the connector structure A, as shown in FIG. 1, the male-side engaging member $A_6$ that is approximately equal in thickness to the female-side engaging member $A_4$ is fixedly arranged on the peripheral edge portion of the flexible circuit board $A_5$.

Figure 24:
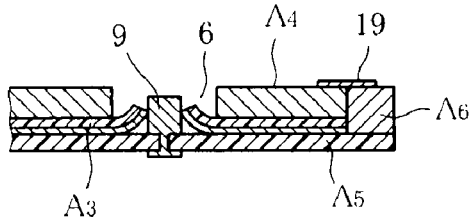
FIG. 24 is a partially sectional view showing a state that a female connector and a male connector have been assembled to each other by using a tab piece.

In this structure, as shown in FIG. 24, a tab piece 19 is attached to a top face of the male-side engaging member $A_6$, and a top face of the female-side engaging member $A_4$ fixedly arranged on one face of the flexible circuit board $A_3$ is pushed by the tab piece 19 so that such a structure that the entire female connector has been assembled to the male connector is obtained. If a plurality of tab pieces is attached to the male-side engaging member $A_6$, the retaining force between both the connectors in this connector structure can be significantly increased.

Figure 25:
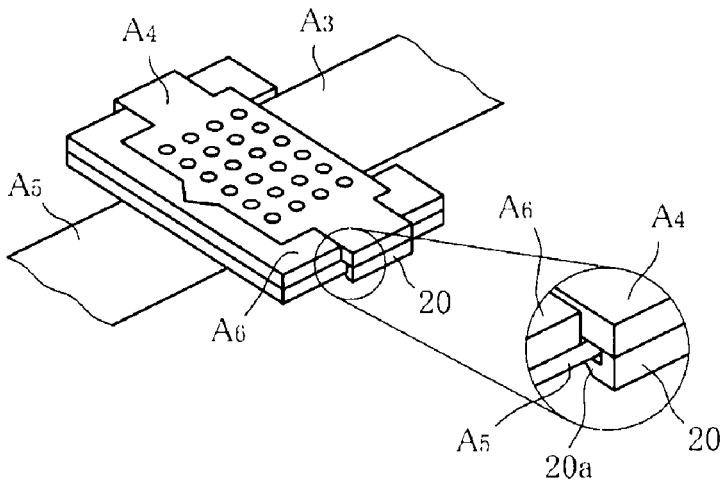
FIG. 25 is a partially sectional view showing a state that a female connector and a male connector have been assembled by using hooks.

As shown in FIG. 25, it is also possible to adopt such an assembled structure that side portions of the female-side engaging member $A_4$ are protruded from peripheral edge portions of the flexible circuit board $A_5$ on which the male-side engaging member $A_6$ is not fixedly arranged, and hooks 20 whose distal ends are catching portions 20*a* which can catch a peripheral end portion of the circuit board $A_5$ are provided on back faces of the side portions in a hanging manner, so that the peripheral end portions of the circuit board $A_5$ are caught by the catching portions 20*a* to hold the male connector by the hooks 20.

Next, in the case of the connector structure B and the connector structure C, since the male-side engaging members $B_6$ ($C_6$) are, for example, column-shaped projections that are protruded at four corners, such a tab piece as shown in FIG. 24 cannot be attached to the column-shaped projections. This is because the positioning and guiding function cannot be exerted.

Figure 26:
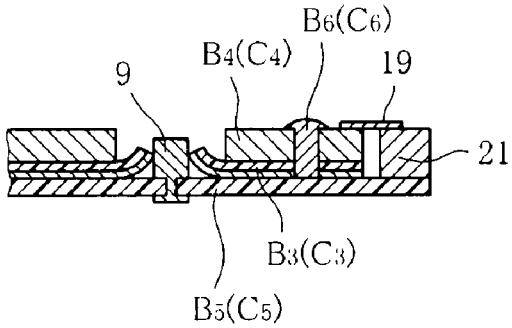
FIG. 26 is a partially sectional view showing another assembled state using a tab piece.

Therefore, in the case of these connector structures, as shown in FIG. 26, it is possible to adopt a structure in which a height adjusting member 21 that is approximately equal in thickness to the female-side engaging member is fixedly arranged along a peripheral edge portion of the circuit board $B_5$ ($C_5$) and the tab piece 19 is attached thereon to push a top face of the female-side engaging member $B_4$ ($C_4$).

However, in the case of the connector structure B and the connector structure C, as shown in FIGS. 17 and 23, the peripheral edge portion of the circuit board $B_5$ ($C_5$) except for spots at which the male-side engaging members $B_6$ ($C_6$) are formed is put in an opened state.

Figure 27:
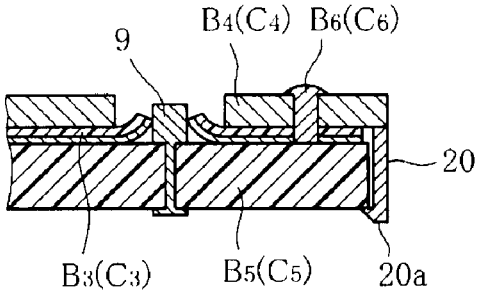
FIG. 27 a partially sectional view showing another assembled state using a hook.

Therefore, as shown in FIG. 27, it is possible to adopt an assembled structure in which a side portion of the female-side engaging member $B_4$ ($C_4$) is protruded from a portion in which the column-shaped projection $B_6$ ($C_6$) is not formed and the hook 20 shown in FIG. 25 is provided on the side portion in a hanging manner so that the peripheral edge portion of the circuit board $B_5$ ($C_5$) is caught by the catching portion 20*a* of the hook 20 to hold the male connector.

INDUSTRIAL APPLICABILITY

As described above, in the case of the connector structures according to the present invention, even if the connecting portion has a multi-pin configuration, a female connector and a male connector can easily be connected to each other at one assembling work by engaging a female-side engaging member fixedly arranged on the female connector that is formed on one face of a flexible circuit board and a male-side engaging member fixedly arranged on the male connector formed on one face of a circuit board that may be a flexible circuit board or a rigid circuit board with each other. At the same time, positioning of both the connectors to each other is easily performed, and the connecting portions are firmly retained, so that the reliability of the connection between both the connectors is increased.

For example, for the purpose of a connection between an FPC (flexible printed circuit board) and an FPC, a connection between an FPC and an RPC (rigid printed circuit board), or the like, the connector structures can be further thinned, reduced in size, and increased in density, as an alternative to an existing board-to-board connector or an EPC connector. Further, a multi-pin connection containing 200 or more pins becomes possible, though it is impossible in the above existing connector. Further, as intended purpose, the connector structure can be used for a connection between a mother board and a panel of a flat panel display, such as a liquid crystal display, a plasma display, or an electronic paper, in a digital electronic apparatus such as a mobile phone, a digital camera, or a digital video camera, a connection between a mother board and an FPC for a camera module, or the like. Also in a medical-equipment related field, the connector structure according to the present invention is thought to be useful for a connection between an FPC mounted with an ultrasonic device and an FPC and an RPC, or a connection between an FPC and an FPC and an RPC in an endoscopic camera module that is required to be microminiaturized.

REFERENCE SIGNS LIST

A, B, C: connector structure
$A_1$, $B_1$, $C_1$: female connector
$A_2$, $B_2$, $C_2$: male connector
$A_3$, $B_3$, $C_3$: flexible circuit board
$A_4$, $B_4$, $C_4$: female-side engaging member
$A_5$, $B_5$, $C_5$: circuit board
$A_6$, $B_6$, $C_6$: male-side engaging member
D: female terminal portion
E: male terminal portion
1: insulating film
1*a*: formation face of pad portion
1*b*: opposite face from formation face of pad portion
2: pad portion
3: conductor circuit pattern
4: first through-hole
5: small hole
6: second through-hole
6*a*: shelf-shaped portion
7: spring arm portion (elastically deformable portion)
7*a*: wedge-shaped slit
7*b*: fulcrum
7*c*: outer wall face of spring arm portion 7
7*d*: projecting portion
8: projecting portion
9: connecting pin
9*a*: distal end portion of connecting pin 9
9*b*: side portion of connecting pin 9
10: receiving portion
11: notch portion for drawing
12: recessed portion
13*a*: inner wall face of frame-like body $A_6$

13*b*: projecting portion
14: notch ring body
14*a*: proximal portion of notch ring body 14
14*b*: notch portion
14*c*: ring hole
14*d*: notch
14*e*: tapered face
15: column-shaped projection (male-side engaging member)
15*a*: distal end portion of column-shaped projection 15
15*b*: side portion of column-shaped projection 15
16: guide hole
17: column-shaped projection (male-side engaging member)
18: layer of adhesive agent
19: tab
20: hook
20*a*: catching portion of hook 20
21: height adjusting member

The invention claimed is:

1. A connector structure constructed by assembling:

a female connector provided with a flexible circuit board including female terminal portions comprising an insulating film having flexibility, a plurality of pad portions formed on one face of the insulating film, conductor circuit patterns drawn out of the pad portions, first through-holes formed in a thickness direction of the insulating film within faces of the pad portions, and small holes communicating coaxially with the first through-holes and formed within the faces of the pad portions; and a female-side engaging member which is a foil-like body fixedly arranged on the opposite face of the flexible circuit board from a formation face of the pad portions thereof and which has second through-holes with a size larger than those of the first through-holes communicating coaxially with the first through-holes in the female terminal portions and formed in a thickness direction of the foil-like body; and a male connector provided with a circuit board including male terminal portions comprising an insulating member, connecting pins formed in a projecting manner on one face of the insulating member at positions corresponding to the female terminal portions, and conductor circuit patterns drawn out of proximal portions of the connecting pins; and a male-side engaging member which is fixedly arranged on the same face as a formation face of the connecting pins of the circuit board and is engaged with the female-side engaging member, wherein the female-side engaging member is fixedly arranged on the flexible circuit board in the state where the respective female terminal portions and portions of the flexible circuit board positioned in the vicinities of the female terminal portions are positioned within the respective faces of the second through-holes and the other portion of the flexible circuit board and the female-side engaging member are integrated with each other.

2. The connector structure according to claim 1, wherein the female-side engaging member and the male-side engaging member are fixedly arranged on the flexible circuit board and the circuit board, respectively, so as to maintain such a predetermined positional relationship that the female terminal portions and the male terminal portions can be connected to each other.

3. The connector structure according to claim 1, wherein either one or both of the female-side engaging member and the male-side engaging member exert a positioning and guiding function to the other at an engaging time of the female-side engaging member and the male-side engaging member and a retaining function to the other after the female-side engaging member and the male-side engaging member are engaged with each other.

4. The connector structure according to claim 1, wherein the female-side engaging member has grooves formed into a shape that receives the second through-holes in each line collectively.

5. The connector structure according to claim 1, wherein at least one projecting portion or recessed portion is formed at a desired position of the female-side engaging member in a widthwise direction thereof, and a recessed portion or a projecting portion that is fitted to the projecting portion or recessed portion when the female-side engaging member and the male-side engaging member are engaged with each other is formed in the male-side engaging portion so that a positioning and guiding function to the female-side engaging member at the engaging time of the female-side engaging member and the male-side engaging member is exerted.

6. The connector structure according to claim 1, wherein a layer of adhesive agent is formed partially or entirely on the face of the flexible circuit board except for the formation face of the pad portions, or partially or entirely on the face of the circuit board except for the formation face of the connecting pins, the connecting pins of the male terminal portions are inserted via the small holes into the first through-holes of the female terminal portions from the formation face of the pad portions, the pad portions and portions of the insulating film on which the pad portions are formed are flexed in an insertion direction of the connecting pins, the pad portions are brought into pressure contact with the connecting pins by elasticity of the pad portions and insulating film, and the female connector and the male connector are bonded to each other via the layer of adhesive agent.

7. The connector structure according to claim 1, wherein a tab piece is arranged on an upper face of the male-side engaging member of the male connector so that the male connector and the female connector are assembled to each other by pushing an upper face of the female-side engaging member of the female connector by the tab piece.

8. The connector structure according to claim 1, wherein a hook having a catching portion at a distal end thereof and extending downward is arranged on a peripheral edge portion of the female-side engaging member in the female connector so that the male connector and the female connector are assembled to each other by holding a back face of the circuit board of the male connector by the catching portion of the hook.

9. The connector structure according to claim 1, wherein the circuit board of the male connector on which the male-side engaging member is fixedly arranged is a flexible circuit board or a rigid circuit board.

10. An electric/electronic apparatus in which the connector structure according to claim 1 is installed.

11. The connector structure according to claim 1, wherein the connecting pins are larger in diameter than the first through-holes and smaller in diameter than the second through-holes.

12. The connector structure according to claim 11, wherein the connecting pin has a distal end portion and a side portion that is positioned closer to a proximal end than the distal end is, and the distal end portion is larger in diameter than the side portion.

13. The connector structure according to claim 1, wherein annular resin elastic bodies having the same inner diameter as the first through-holes and having the same outer diameter as the second through-holes are arranged in the second through-holes of the female-side engaging member.

14. The connector structure according to claim 13, wherein the resin elastic bodies are made of cured silicone resin whose rubber hardness degree specified by JIS K 6253 is equal to or less than 100.

15. A female connector used in the connector structure according to claim 1.

16. A male connector used in the connector structure according to claim 1.

17. A flexible circuit board provided with the female connector according to claim 15.

18. A flexible circuit board or a rigid circuit board provided with the male connector according to claim 16.

19. The connector structure according to claim 1, wherein the female-side engaging member has an elastically deformable portion formed as a portion of the foil-like body outside the second through-holes.

20. The connector structure according to claim 19, wherein at an assembling time of the female connector and the male connector to each other, the connecting pins of the male terminal portions are inserted through the small holes into the first through-holes of the female terminal portions from the formation face of the pad portions, the pad portions and portions of the insulating film on which the pad portions are formed are flexed in an insertion direction of the connecting pins, and the pad portions are brought into pressure contact with the connecting pins by elasticity of the pad portions and the insulating film, and the female-side engaging member of the female connector is engaged with the male-side engaging member of the male connector, the elastically deformable portion of the female-side engaging member is brought into pressure contact with the male-side engaging member by elastic force based on elastic deformation of the elastically deformable portion, so that a retaining function between the female-side engaging member and the male-side engaging member is exerted.

21. The connector structure according to claim 19, wherein the elastically deformable portion of the female-side engaging member is a spring arm portion formed on each of both side portions of the foil-like body by providing a wedge-shaped slit whose width becomes narrower along a longitudinal direction of the foil-like body, the male-side engaging member is a frame-like body which partially surrounds the connecting pins and which has a receiving portion for receiving the female-side engaging member and a drawing notch portion for drawing the flexible circuit board, and at an engaging time of the female-side engaging member and the male-side engaging member with each other, an outer wall face of the spring arm portion is brought in pressure contact with an inner wall face on each of both side portions of the frame-like body so that a retaining function between the female-side engaging member and the male-side engaging member is exerted.

22. The connector structure according to claim 21, wherein outer wall faces of the spring arm portions are formed in such a stepped shape that the outer wall faces have projecting portions at lower portions thereof, and an inner wall face of the frame-like body is formed in such a stepped shape that the inner wall face has a projecting portion at an upper portion thereof.

23. The connector structure according to claim 19, wherein the elastically deformable portion of the female-side engaging member is a notch ring body formed integrally with the female-side engaging member, the male-side engaging member is a column-shaped projection having a larger diameter than an inner diameter of the notch ring body, and at the engaging time of the female-side engaging member and the male-side engaging member, the notch ring body is in pressure contact with the column-shaped projection by restoring force of the notch ring body diametrically expanded.

24. The connector structure according to claim 23, wherein the height of the column-shaped projection is larger than the thickness of the notch ring body, a distal end portion thereof is larger in diameter than a proximal end portion thereof, and a tapered face that is larger in diameter than the distal end portion of the column-shaped projection is formed on an inner wall of the notch ring body.

25. The connector structure according to claim 23, wherein a tab piece is arranged via a height adjusting member on an upper face of a peripheral edge portion of the insulating base member in the male connector so that the male connector and the female connector are assembled to each other by pushing an upper face of the female-side engaging member of the female connector by the tab piece.

* * * * *